United States Patent [19]

Stonier

[11] Patent Number: 4,613,870

[45] Date of Patent: Sep. 23, 1986

[54] SPACECRAFT ANTENNA REFLECTOR

[75] Inventor: Roger A. Stonier, San Jose, Calif.

[73] Assignee: Ford Aerospace & Communications Corporation, Detroit, Mich.

[21] Appl. No.: 532,881

[22] Filed: Sep. 16, 1983

[51] Int. Cl.[4] ..... H01Q 1/28

[52] U.S. Cl. ..... 343/915; 343/DIG. 2

[58] Field of Search ..... 343/840, 912, 915, DIG. 2

[56] References Cited

U.S. PATENT DOCUMENTS

| | | | |
|---|---|---|---|
| 3,264,649 | 8/1966 | White | 343/915 |
| 3,360,798 | 12/1967 | Webb | 343/915 |
| 3,397,399 | 8/1968 | Carman et al. | 343/915 |
| 3,406,404 | 10/1968 | Maier | 343/915 |
| 3,713,959 | 1/1973 | Carman et al. | 161/59 |
| 3,716,869 | 2/1973 | Gould, Jr. et al. | 343/912 |
| 3,886,557 | 5/1975 | Townes et al. | 343/912 |
| 3,969,731 | 7/1976 | Jenkins et al. | 343/840 |
| 4,030,103 | 6/1977 | Campbell | 343/915 |
| 4,295,143 | 10/1981 | Winegard et al. | 343/915 |
| 4,315,265 | 2/1982 | Palmer et al. | 343/840 |

*Primary Examiner*—Eli Lieberman

*Attorney, Agent, or Firm*—Edward J. Radlo; Kenneth R. Allen; Clifford L. Sadler

[57] ABSTRACT

An antenna reflector structure of the offset-fed type which is suitable for use on spacecraft. The reflector structure includes a central boom, a number of spaced ribs on the boom, an RF reflective mesh layer adjacent to the outer, transverse peripheral edges of the ribs, and contoured angle members for securing the mesh layer to the ribs to provide a specific contour for the reflector surface defined by the mesh layer. The boom can be of one-piece construction or formed from telescoped segments. The reflector structure is deployable and furlable. Several embodiments of the reflector structure are disclosed.

18 Claims, 13 Drawing Figures

FIG._2.
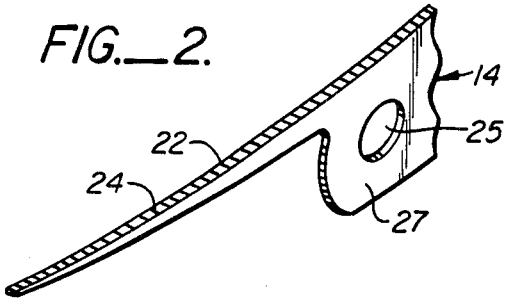
FIG._3.
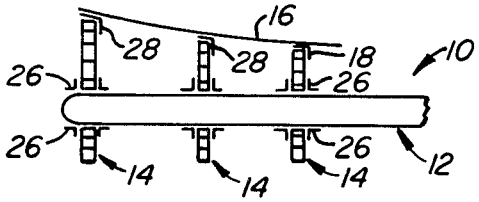
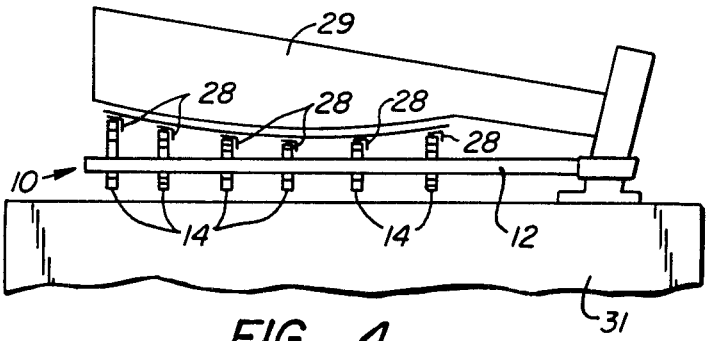
FIG._4.
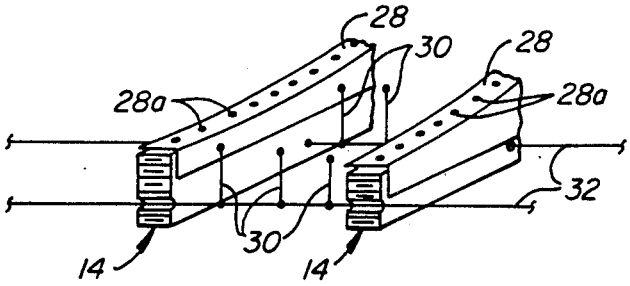
FIG._5.

SPACECRAFT ANTENNA REFLECTOR

This invention relates to spacecraft antenna reflector structures of the type which are deployable and furlable.

BACKGROUND OF THE INVENTION

The use of graphite epoxy materials for making spacecraft antenna reflector structures is now fairly standard for almost all spacecraft systems. Old designs using fiberglass composite or aluminum sandwich structures are now obsolete. The use of graphite composites provides a lighter weight reflector which is also, because of the low thermal coefficient of expansion of the graphite fiber, much more dimensionally stable when exposed to in-orbit thermal conditions. In fact, the excellent dimensional stability of these graphite reflector structures usually exceeds what is actually required for the operating frequencies of X, S and C-bands which are used for most satellite communication antennas.

Even though graphite composite reflectors may in some cases be better dimensionally than what is required, they are still lighter in weight (for equivalent structural capability) than the older designs. However, graphite composite reflectors are very expensive to manufacture. What is needed, therefore, is an improved antenna reflector for spacecraft use which provides the necessary degree of dimensional stability and is lighter in weight than current graphite reflector designs and which can be easily manufactured at a significantly lower cost than existing antenna reflectors.

A number of spacecraft antenna reflectors have been developed which use metal or metallized mesh or fabric materials for the RF reflective surface of the reflector. These reflector structures are usually very large in diameter (12 feet diameter or greater) and are "folded-up" before launch to fit into the space constraints of the launch vehicle. The reflector is then unfurled in-orbit. Current designs for furlable reflectors include the radial rib type, the hoop/column (maypole) type, the expandable truss type, and the inflatable type.

Recent flight programs with furlable reflectors have used the radial rib concept. A 30-foot diameter flexible "wrap-rib" reflector was used on the NASA ATS-6 (Applications Technology Satellite) program. A rigid radial rib design is being used on the FLTSATCOM (Fleet Satellite Communications) satellite, and two 16 foot diameter rigid rib reflectors are used on the TDRSS (Tracking and Data Relay Satellite System) program. The Galileo spacecraft will also use a rigid rib furlable reflector that will operate at X and S-band frequencies.

All of the above furlable reflectors are center-fed, axisymmetric parabolic antennas. No offset-fed parabolic segment furlable reflectors have been used on flight programs; moreover, this type of furlable reflector would be extremely difficult to develop. For reflectors of 12 foot diameter and larger, the unsymmetrical configuration of an offset fed reflector creates unique problems associated with the unfurling of ribs of varying lengths from the center hub which is needed to attach the ribs. Thus, an additional need exists for an antenna design which is better suited for an offset reflector than for an axisymmetric design. Such a new concept would be particularly attractive where spacecraft height must be minimized. For instance, use of the Space Shuttle for launching medium class satellites will require positioning of the satellite upright in the shuttle bay to minimize launch costs. An antenna design with an offset reflector, if used in a furlable mode, would allow for the design of a spacecraft structure of greater height and increased size and added capability for the shuttle launch.

The only known flight application of mesh used for a rigid spacecraft reflector (non-furlable) is in a design in which the mesh was attached to an offset parabolic dish "skeleton". This type of reflector was used to minimize the "solar torque" effect of the solar wind on a satellite and was first used on the Anik Canadian domestic satellite. It was characterized as follows: It utilized a room temperature curing graphite prepreg material; it required an expensive parabolic contoured lay-up tool; it used a high expansion metal mesh material for the RF surface; and it required an intricate machining away of portions of the graphite composite shell to provide the open areas of the "skeleton" over which the mesh was stretched. Such a reflector design cannot be easily modified to obtain a furlable antenna. The dimensional accuracy of the Anik antenna reflector was not good, primarily because the design does not accommodate the unique characteristics of the mesh material which does not conform to the required parabolic shape in the unsupported areas. A 12-foot diameter rigid "breadboard" reflector using a mesh RF surface was built by Jet Propulsion Laboratories for a development program. It consisted of a rigid aluminum truss structure with a metallic mesh material. It was based on a conical RF surface and a line source RF feed, but it never progressed beyond the development stage.

The following prior U.S. patents relate to spacecraft and satellite antenna reflectors:

| | |
|---|---|
| 3,360,798 | 3,716,869 |
| 3,397,399 | 3,969,731 |
| 3,406,404 | 4,030,103 |
| 3,713,959 | 4,315,265 |

SUMMARY OF THE INVENTION

The present invention provides a new spacecraft antenna reflector structure which is offset-fed. The invention is based on the use of lightweight graphite composite ribs mounted on a boom which can be deployed, and an RF reflective mesh material coupled to the composite ribs to provide the reflector structure for the antenna. The invention offers major advantages over conventional unstiffened or rib stiffened rigid graphite composite reflector shells. It is much lighter in weight and is also less expensive to manufacture due to the elimination of expensive parabolic molding tools and to the reduced use of high cost graphite prepreg materials.

Among the other advantages of the present invention is that it has minimal "solar torque" effect and has low thermal distortion. It can both be deployable and furlable so as to be much more versatile for spacecraft use than conventional antenna reflector structures. The invention also provides the necessary degree of dimensional stability and can be easily manufactured at a significantly lower cost than conventional antenna structures used for the same purpose.

Generally, the antenna reflector of the present invention includes a central, graphite, composite boom with a number of graphite composite ribs coupled to and spaced along the length of the boom. To achieve improved stiffness over a conventional graphite composite laminate rib, a honeycomb sandwich rib using thin graphite skins can be used. So that precise machining of the required parabolic contour is not required on each honeycomb rib, as it is on each laminate rib, a graphite, laminate angle is attached to each rib, respectively, to control the required contour of the reflector mesh which is stretched across and attached to these members. Guy wires of aramid fiber can be used to apply tension to the ribs to avoid the need for heavier rigid rib structures. Mesh contour control in unsupported areas between the ribs can be achieved with tie threads which tension the mesh into position.

The primary object of the present invention is to provide an improved antenna reflector structure of the offset fed type suitable for use on spacecraft wherein the structure is made of lightweight graphite composite material and has an improved RF reflective surface of mesh material so that the structure is much lighter in weight than conventional antenna reflector structures, it can be manufactured at minimal cost, and it is both deployable and furlable.

Other objects of the present invention will become apparent as the following specification progresses, reference being had to the accompanying drawings for illustrations of several embodiments of the invention.

IN THE DRAWINGS

FIG. 2 is an enlarged, fragmentary, perspective view of one of the ribs for mounting on the boom of the invention;

FIG. 3 is a schematic view of the embodiment of the invention of FIG. 1, showing the way in which members attached to the ribs are used to control the contour of the reflecting mesh of the invention;

FIG. 4 is a view similar to FIG. 3 but showing a contour measuring template for checking and adjusting the accuracy of the contour of the mesh;

FIG. 5 is an enlarged, schematic view of the embodiment of FIG. 1, showing tie-down threads for maintaining the contour of the mesh between adjacent ribs;

Figure 1:
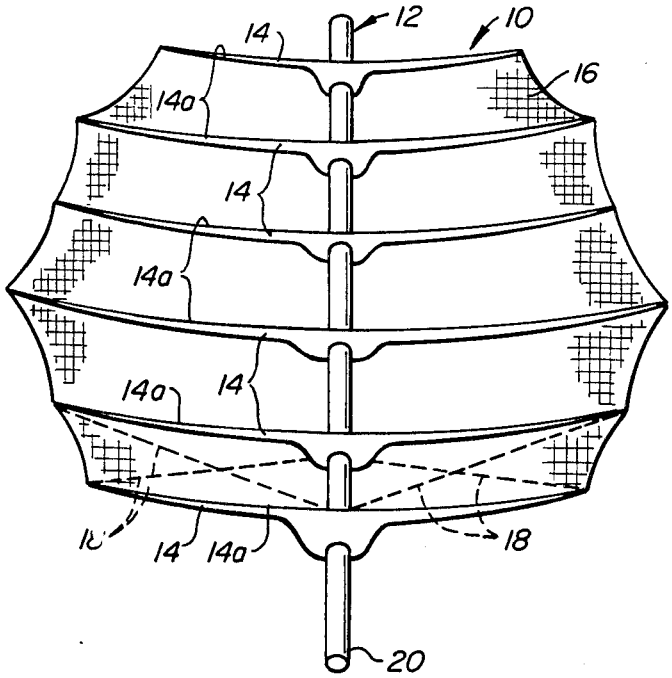
FIG. 1 is a perspective view of a first embodiment of the antenna reflector structure of the present invention.

A first embodiment of the antenna reflector structure of the present invention is broadly denoted by the numeral 10 and is shown in FIG. 1. Structure 10 includes a central boom 12, a number of ribs 14 at spaced locations along the length of the boom, and an RF mesh layer 16 mounted on the ribs to define the reflecting surface for structure 10. If desired, aramid fiber guy wires can be used to apply tension to the ribs. Such guy wires are broadly denoted by the numeral 18 and shown in dashed lines in FIG. 1. Guy wires can be used at other locations on structure 10 but are omitted in FIG. 1 to simplify the drawing.

Each rib 14 has an outer peripheral edge **14*a* which extends from one end of the rib to the opposite end thereof. This peripheral edge is a generally contoured surface as shown in FIG. 2 and extends laterally from boom 12** in opposite directions. The peripheral edge is spaced slightly outwardly of the boom in a direction substantially normal to the directions in which the rib extends.

Figure 1A:
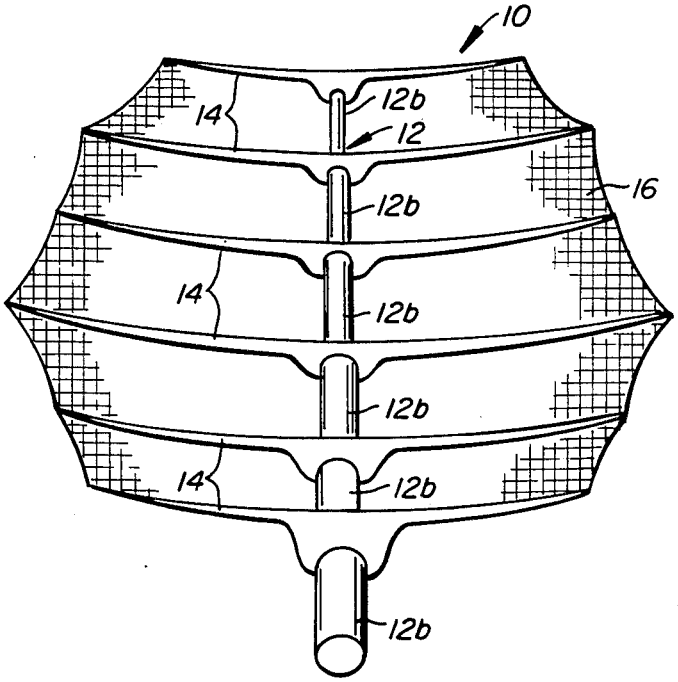
FIG. 1A is a view similar to FIG. 1 but showing a second embodiment of the antenna reflector structure.
Figure 6:
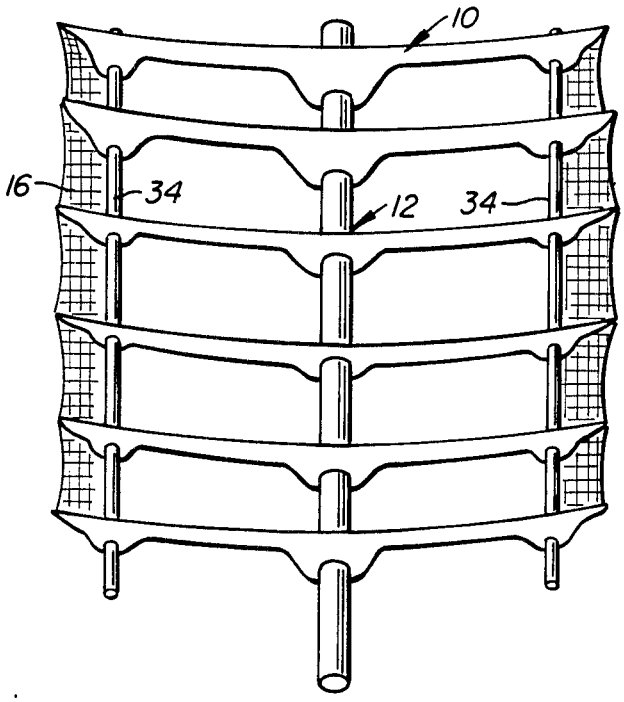
FIG. 6 is a view similar to FIGS. 1 and 1A but showing another embodiment of the invention.

Boom 12 generally is tubular and formed of a graphite composite material. If structure 10 is to be deployable, the boom will be a one-piece tube. The tube will be provided with a metal "elbow joint" (such as hinging mechanism 52 in FIG. 10) at the lower end 20 to fold the structure 10 against the outer surface of a spacecraft. If a large diameter reflector is required, a furlable design would be of the type shown in FIG. 1A in which a central boom **12*a* would be comprised of a telescoping set of tubes 12*b*. Extension of boom 12*a* to open reflector and unfurl it from a collapsed condition (FIGS. 8 and 9) would be accomplished with a gas pressurization technique. This type of gas pressurization technique is currently used to extend the "nose tip" probe on the Trident missile system. A gas generator within the lowermost tube segment 12*b* is actuated to release a gas under pressure, causing the other segments 12*b* to move away from lowermost segment 12*b*** until the boom is fully extended.

In general, the configuration of the central boom depends upon the size of the structure 10, whether the reflector is deployable or furlable, and upon the structural loading conditions during launch of a spacecraft on which the antenna structure 10 is mounted. The boom itself can be of circular, square or other cross-section. For a stowed, deployable reflector of the size of the larger antenna on the Insat-I satellite program, a 2 to 3 inch diameter circular tube should be structurally adequate.

Boom 12 is preferably of an ultra-high modulus ($E=75$ msi) graphite-epoxy material oriented primarily longitudinally to achieve a very high stiffness and natural frequency. Some graphite layers would be oriented slightly off-axis to achieve a near zero thermal coefficient of expansion. The boom also contains a high strength graphite fabric for circumferential strength and the boom is manufactured using conventional molding processes.

The detail of each rib 14 is shown in FIG. 2. Each rib is formed of a honeycomb sandwich using graphite skins 22 bonded to a central honeycomb core 24. The number of ribs required on boom 12 depends upon the reflector diameter and the RMS surface accuracy requirement of structure 10. Ribs 14 have holes 25 in flanges 27 for receiving boom 12, and the flanges are attached by small angles 26 to boom 12. Angles 26 are adhesively bonded both to the boom 12 and to flanges 27. Precise machining of the ribs is not required since they do not control the RF surface contour of mesh layer 16. The ribs can all be machined by hand routing from a single honeycomb sandwich panel. Locations of ribs 14 on boom 12 prior to their attachment is controlled by a simple jig or other tool.

The precise parabolic contour for mesh layer 16 on ribs 14 is controlled by machined contour laminates or molded angle members 28 (FIG. 3). Angles 28 are formed of graphite laminate material and the angles are first attached mechanically to respective ribs until they are accurately located and then they are adhesively bonded. The required contour is molded into angles 28; thus, no dimensionally critical machining steps are required in the manufacture of the angles as is required if contoured laminates were used. Correct positioning of the contour controlling angles 28 is accomplished with templates such as template 29 above structure 10 mounted on a granite block 31. Such positioning can be checked and minor adjustments can be made at the time of installation of the mesh layer 16 or thereafter, using a three-axis inspection machine. Adjustments of angles 28 is accomplished mechanically and, when the required accuracy is achieved, the angles are "locked-in" their operative positions by adhesive bonding to respective ribs. This bonding is accomplished without removal of the angles 28 from ribs 14.

The RF mesh layer 16 preferably is formed of an RF conductive tricot knit material. Another type of material that is suitable is metallized low expansion quartz fiberglass knit material or a fabric utilizing graphite fiber or metallized graphite fiber because they have improved dimensional stability. Attachment of mesh layer 16 to angles 28 (FIG. 3) is preferably accomplished by mechanically tieing the mesh with threads through drilled holes 28*a* (FIG. 5) in the angles 28. These holes do not have to be accurately located or drilled.

The mesh layer 16, due to its inherent flexibility, generally will not conform to the desired parabolic contour in the spaces between ribs 14. Tensioning of the mesh layer will tend to cause a "lamp-shade" effect between adjacent ribs 14. To minimize this effect, more ribs 14 can be added. In the alternative, tie threads of graphite or quartz glass can be used to tension the mesh layer and "pull" it to the correct contour in the unsupported areas between adjacent ribs 14.

FIG. 5 shows a number of first threads 30 which are secured to second threads 32 extending longitudinally of boom 12, the outer ends of the first threads 30 being secured to mesh layer 16 (not shown in FIG. 5). Second threads 32 are graphite or quartz glass cables which are attached to the back portions of ribs 14 and pass through the ribs. The number of first threads 30 will depend upon the RMS requirement for the RF surface of mesh layer 16. This requirement will, in turn, depend upon the antenna operating frequency. A trade-off can be made in which the weight of additional ribs on boom 12 are compared with the cost of the labor required to adjust first threads 30. There are a number of techniques that can be used to make one first thread more effective in controlling the contour of the mesh layer 16 over a large area.

Aramid fiber guy wires 18, if used in the manner shown in FIG. 1, are provided as structural elements between adjacent ribs 14 and between ribs 14 and boom 12 to minimize rib tip deflections during the vibration loading at launch. In lieu of guy wires 18, another embodiment of structure 10 can use two smaller diameter graphite tubes 34 coupled with ribs 14 near their outer ends and being parallel with boom 12. However, aramid guy wires have an advantage in that they are lighter and have a near-zero thermal coefficient of expansion; thus, they will not distort ribs 14 and mesh layer 16 under in-orbit thermal conditions.

The present invention can provide a "growth" capability in that the same basic reflector structure can be converted to a new type of PSS (Polarization Selective Surface) reflector. For LP (Linear Polarization) antenna systems, the basic concept can be changed to incorporate both RF surfaces into the same structure and also provide a furlable capability. A furlable PSS antenna has never been attempted before.

Figure 7:
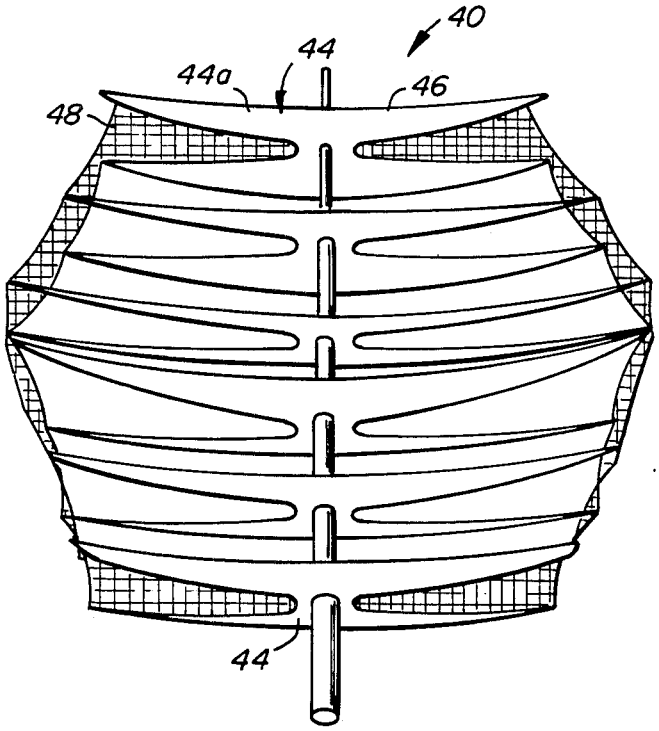
FIG. 7 is a schematic side elevational view of another embodiment of the invention.
Figure 7A:
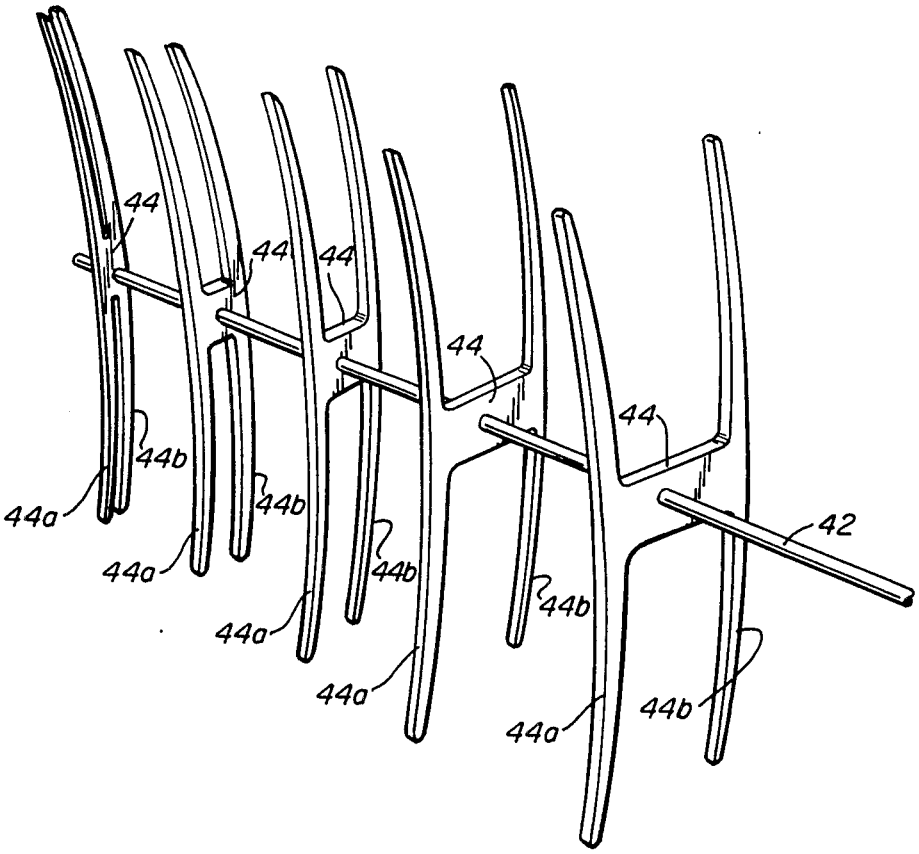
FIG. 7A is a perspective view of the boom and rib structure of the embodiment of FIG. 7.

FIG. 7 shows in schematic form a PSS antenna reflector structure 40 having a central boom 42 and spaced ribs 44 on boom 42. A perspective view of boom 42 and ribs 44 is shown in FIG. 7A. A first mesh layer 46 is on the front, concave peripheral edges 44*a* of ribs 44, and a second mesh layer 48 is secured on the rear, substantially convex peripheral edges 44*b* of ribs 44. This construction provides a pair of RF surfaces on structure 40.

For structure 40, dielectric materials are required. The skins of ribs 44 are converted to aramid fiber materials, and the honeycomb core of ribs 44 is converted to aramid core to produce an RF transparent rib. The contour controlling rib angles (see angles 28 in FIG. 3) would also be fabricated from aramid composite. Graphite tie threads (see FIG. 5) would be replaced with quartz glass. A metallic wire or graphite thread would be incorporated with a non-metallic tricot knit in a special way to allow for axial placement of the conductive strips so that they are parallel in the plane of projection and orthogonal to the RF boresight. An optical projection system could be used to align and inspect the reflector because of its transparency. Prior art has not shown any technique for combining both PSS surfaces required for a reflector of this type into the same sandwich shell, and two separate, non-graphite reflectors must be used with one behind the other with intermediate structure to align them and make them act structurally as one unit.

It might be argued that, with the mesh design of FIG. 7, the internal ribs between the antenna RF feed and the back PSS surface is undesirable due to RF blockage. However, the embodiment of FIG. 7 is actually better than the conventional antenna structures which use two rigid aramid reflector shells. With the conventional structures, the RF energy passing through the front reflector metal grid must penetrate the following: the front aramid skin, the aramid or other non-metallic honeycomb core in the sandwich, the back aramid skin, the adhesive layers bonding both of these skins to the core, and the honeycomb sandwich structure on the backside of the front reflector holding the two shells together, all before reaching the back PSS surface. The embodiment of FIG. 7 has significantly less blockage.

Figure 8:
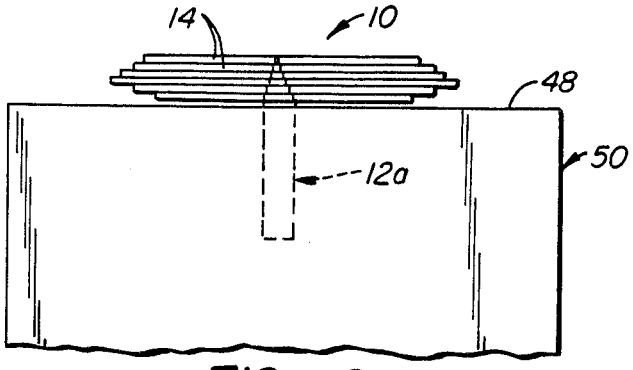
FIGS. 8–10 are different views of the embodiment of FIG. 1A, showing the way in which it is both deployable and furlable.
Figure 9:
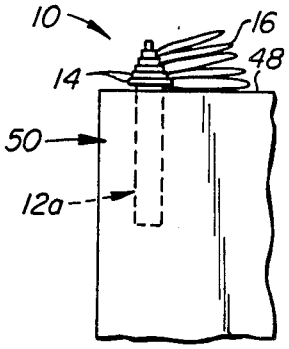
Figure 10:
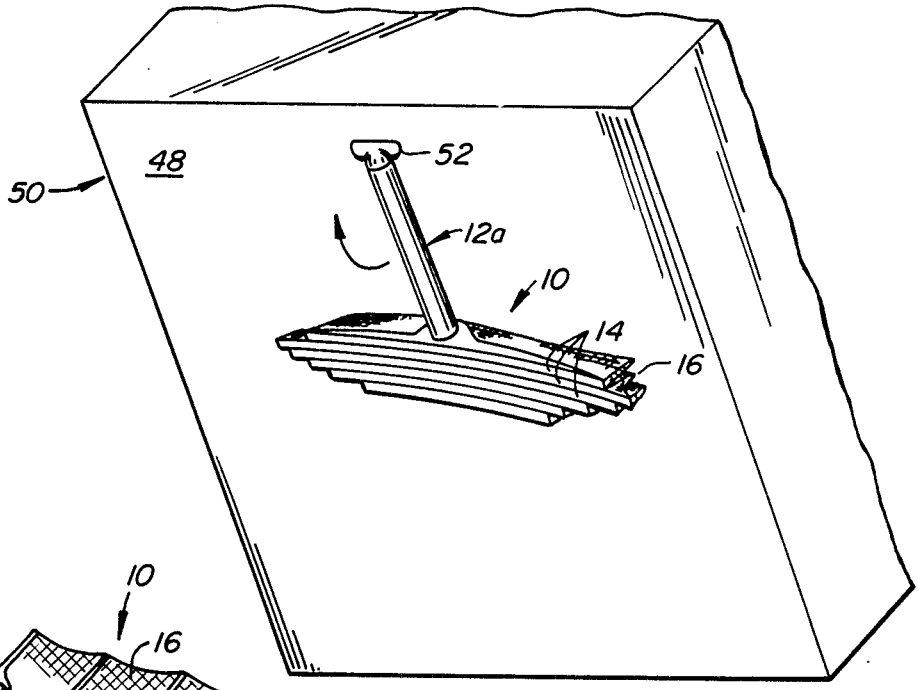

FIGS. 8–10 shows structure 10 in its collapsed or furlable condition on one side 48 of a spacecraft 50. Structure 10 has its boom 12*a* collapsed so that ribs 14 form a stack as shown, for instance, in FIGS. 8 and 9. FIG. 9 shows the mesh layer 16 forming loops inasmuch as the mesh layer 16 is secured by angles 28 to respective ribs 14. FIG. 10 shows structure 10 which is deployable on spacecraft 50 as well as unfurlable therefrom. A hinging mechanism 52 can be provided to cause boom 12 to swing away from surface 48 of spacecraft 50 before the unfurling action takes place.

Figure 11:
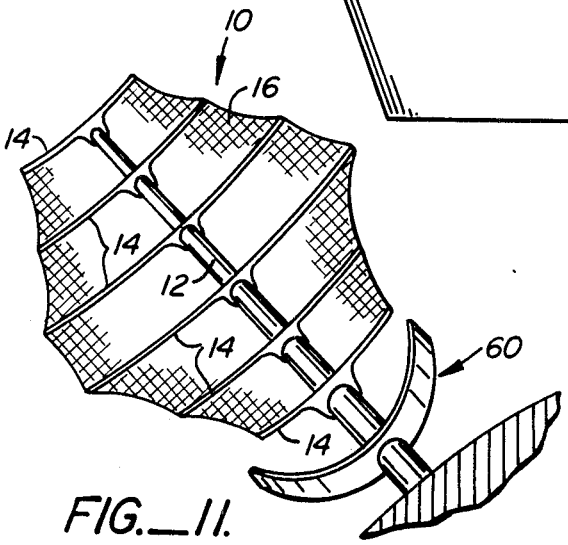
FIG. 11 is a view similar to FIG. 1A but showing the way in which the reflector structure is attached to a curved member.

FIG. 11 shows that ribs 14 of structure 10 can be designed to be flexible enough to wrap into a curved stowing structure 60. In this configuration, the mechanical packaging is similar to the "wrap-rib" concept.

The present invention provides a mesh reflector structure having a much lighter weight and capable of being manufactured at a lower cost than conventional structures. Graphite reflectors currently in use on medium class satellites (like Insat-I and Arabsat) cost in excess of several hundred thousand dollars per flight unit, not including non-recurring development costs. PSS reflectors are even more expensive. The major cost of this new reflector is not in fabrication but in contour adjustment and verification. The techniques for contour control, including tooling, equipment and software, will be developed in the non-recurring phase of a program resulting in very low cost flight units. The weight of the Insat-I satellite C/S band antenna 63"×60" reflectors is 13.6 lbs. Structure 10 in the same size will weight less than 10 lbs.

What is claimed is:

1. Antenna reflector structure for spacecraft use comprising: an elongated central boom mounted on the space craft for supporting the reflector structure relative thereto; a number of ribs mounted on the boom at spaced locations along the length thereof, each rib having an outer peripheral edge spaced laterally from the boom and extending in opposite directions from the boom; an RF conductive mesh adjacent to said edges of the ribs; and means coupling the mesh layer to the ribs at said edges thereof with the mesh layer having a predetermined contour.

2. Antenna reflector structure as set forth in claim 1, wherein the boom is of a one-piece construction.

3. Antenna reflector structure as set forth in claim 1, wherein the boom is collapsible and expandable.

4. Antenna reflector structure as set forth in claim 3, wherein the boom is comprised of a plurality of relatively telescoped tubular segments, and means coupled with the boom for expanding the boom to extend the segments relative to each other.

5. Antenna reflector structure as set forth in claim 1, wherein the boom is tubular and formed of a graphite composite material.

6. Antenna reflector structure as set forth in claim 1, wherein each rib includes a honeycomb sandwich comprised of a honeycomb core and a pair of graphite skins bonded to the honeycomb core.

7. Antenna reflector structure as set forth in claim 6, wherein the honeycomb core is of aluminum.

8. Antenna reflector structure as set forth in claim 1, wherein said coupling means includes a contour controlling angle member for each rib, respectively, each angle member being secured to the outer peripheral edge of the respective rib.

9. Antenna reflector structure as set forth in claim 8, wherein each angle member is molded from a graphite laminate material.

10. Antenna reflector structure as set forth in claim 8, wherein each angle member is adhesively bonded to the respective rib.

11. Antenna reflector structure as set forth in claim 1, wherein the mesh material is formed from a metallized tricot knit material.

12. Antenna reflector structure as set forth in claim 1, wherein said mesh material includes a graphite fiber or metallized graphite fiber material to provide dimensional stability.

13. Antenna reflector structure as set forth in claim 1, wherein is included a number of tie threads coupled to the mesh layer at locations between the ribs to stabilize the contour of the mesh layer.

14. Antenna reflector structure as set forth in claim 13, wherein is included second threads extending longitudinally of the boom and through the ribs, said tie threads being coupled to the second threads.

15. Antenna reflector structure as set forth in claim 1, wherein the coupling means includes an angle member for each rib, respectively, each angle member having a rigid contour-defining segment provided with a plurality of holes therethrough for receiving threads for securing the mesh to the angle member.

16. Antenna reflector structure as set forth in claim 1, wherein is included a number of guy wires for preventing tip deflection of the ribs relative to the boom.

17. Antenna reflector structure as set forth in claim 1, wherein the ribs have outer tips and the boom has a pair of opposed sides, and wherein is included a rigid shaft near the outer tips of the ribs on one side of the boom to prevent deflections of the ribs relative to the boom.

18. Antenna reflector structure as set forth in claim 1, wherein the boom has a pair of opposed sides, each rib having a first outer peripheral edge on one side of the boom and a second outer peripheral edge on the opposite side of the boom from the first outer peripheral edge, and including a second mesh layer adjacent to the second edges of the ribs to provide a pair of mesh surface with RF reflective grids, and means for securing the second mesh layer to the second edges with the second mesh layer having a preselected contour.

* * * * *